US009939759B2

(12) United States Patent
Onishi et al.

(10) Patent No.: US 9,939,759 B2
(45) Date of Patent: Apr. 10, 2018

(54) BELT TENSION ADJUSTMENT MECHANISM AND IMAGE FORMING APPARATUS

(71) Applicant: KONICA MINOLTA, INC., Chiyoda-ku, Tokyo (JP)

(72) Inventors: Jun Onishi, Hino (JP); Masahito Takano, Koganei (JP); Takashi Fujiwara, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/287,238

(22) Filed: Oct. 6, 2016

(65) Prior Publication Data

US 2017/0023889 A1 Jan. 26, 2017

Related U.S. Application Data

(62) Division of application No. 14/942,712, filed on Nov. 16, 2015, now abandoned.

(30) Foreign Application Priority Data

Dec. 16, 2014 (JP) ..... 2014-253697

(51) Int. Cl.
*G03G 15/16* (2006.01)

(52) U.S. Cl.
CPC . *G03G 15/1615* (2013.01); *G03G 2215/0129* (2013.01)

(58) Field of Classification Search
CPC ..... G03G 15/1615
See application file for complete search history.

(56) References Cited

U.S. PATENT DOCUMENTS

| | | | |
|---|---|---|---|
| 2,060,266 | A | 11/1936 | Thompson et al. |
| 2,677,922 | A | 5/1954 | McGuire et al. |
| 5,671,464 | A | 9/1997 | Kubota et al. |
| 6,269,231 | B1 | 7/2001 | Castelli et al. |

(Continued)

FOREIGN PATENT DOCUMENTS

| | | | |
|---|---|---|---|
| JP | 2002006573 | A | 1/2002 |
| JP | 2008145680 | A | 6/2008 |

OTHER PUBLICATIONS

Japanese Office Action (and English translation thereof) dated Jan. 24, 2017 issued in counterpart Japanese Application No. 2014-253697.

*Primary Examiner* — Ryan Walsh
(74) *Attorney, Agent, or Firm* — Holtz, Holtz & Volek PC

(57) ABSTRACT

A belt tension adjustment mechanism provided on an inner side of an endless intermediate transfer belt and applying a tension to the intermediate transfer belt being rotated when a toner image is transferred on the intermediate transfer belt, said belt tension adjustment mechanism includes a holder having an opening section at one surface thereof; and an elastic member contained to be fixed in the holder while being compressed in a running direction of the intermediate transfer belt and having a convex section, wherein the convex section protrudes from the opening section of the holder toward a direction orthogonal to an image transfer surface of the intermediate transfer belt and is in direct contact with the intermediate transfer belt.

13 Claims, 7 Drawing Sheets

(56) References Cited

U.S. PATENT DOCUMENTS

| | | | | |
|---|---|---|---|---|
| 2011/0194879 | A1* | 8/2011 | Nomura | G03G 15/0131 399/310 |
| 2013/0236218 | A1* | 9/2013 | Inagaki | G03G 15/0131 399/302 |

* cited by examiner

BELT TENSION ADJUSTMENT MECHANISM AND IMAGE FORMING APPARATUS

CROSS-REFERENCE TO RELATED APPLICATIONS

This is a Divisional of U.S. application Ser. No. 14/942,712, filed Nov. 16, 2015, which is based upon and claims the benefit of priority from prior Japanese Patent Application No. 2014-253697, filed Dec. 16, 2014, the entire contents of both of which are incorporated herein by reference.

BACKGROUND OF THE INVENTION

1. Field of the Invention

The present invention relates to a belt tension adjustment mechanism and an image forming apparatus which includes the belt tension adjustment mechanism.

2. Description of Related Art

Conventionally, there have been known tandem type image forming apparatuses each of which includes image processing units for a plurality of colors such as Y (yellow), M (magenta), C (cyan) and K (black), forms monochrome toner images of respective colors on photoreceptors in the respective image processing units and sequentially transfers the monochrome toner images of the respective colors to form a color image on sheets of paper, for example.

Generally, an intermediate transfer belt for sequentially conveying the monochrome toner images is provided with a predetermined tension. When a thick sheet (heavy paper) having a large thickness is conveyed through a nip section which is formed between the intermediate transfer belt and a secondary transfer roller for transferring (secondary transfer) color toner images on the conveyed sheet, an impact caused by the contact with the thick sheet transfers to the intermediate transfer belt, and the tension provided to the intermediate transfer belt is changed. When the tension provided to the intermediate transfer belt is changed, positions of the respective color monochrome toner images are shifted when they are superposed on each other, which leads to a color deviation.

Thus, in order to minimize the change in tension applied to the intermediate transfer belt, there is disclosed a technique to compensate for the change in vector relationship between the tension of intermediate transfer belt and the load in vertical direction with arms which are supported to be rotatable and stretchable to have a tensile force and a tensioner mechanism which connects the supported arms to each other so as to be rotatable (for example, see Japanese Patent Application Laid-Open Publication No. 2002-6573).

However, the above technique of Japanese Patent Application Laid-Open Publication No. 2002-6573 possibly cannot respond to a rapid change in the tension due to the inertia action of link mechanism to constrain the motion. In addition, there is a large dead force generated at the rotation supporting point with respect to the load which is applied to the intermediate transfer belt by the tensioner mechanism. Thus, the operation of tensioner mechanism is possibly disturbed by the frictional force. As described above, the technique described in Japanese Patent Application Laid-Open Publication No. 2002-6573 has a problem that it is difficult to maintain the tension applied to the intermediate transfer belt to be constant due to the disturbance by inertia force and frictional force.

SUMMARY OF THE INVENTION

The present invention has been made in consideration of the above matters, and an object of the present invention is to provide a belt tension adjustment mechanism which can maintain a tension applied to an intermediate transfer belt to be constant and an image forming apparatus which includes the belt tension adjustment mechanism.

In order to achieve at least one of the above object, according to one aspect of the present invention, there is provided a belt tension adjustment mechanism which is provided on an inner side of an endless intermediate transfer belt and applies a tension to the intermediate transfer belt, the intermediate transfer belt being rotated when a toner image is transferred, and the belt tension adjustment mechanism including an elastic member which reduces a load applied to the intermediate transfer belt along with an increase in an inward displacement amount of the intermediate transfer belt.

Preferably, in the belt tension adjustment mechanism, the elastic member includes a convex section and is disposed so that the convex section protrudes toward a direction orthogonal to an image transfer surface of the intermediate transfer belt.

Preferably, in the belt tension adjustment mechanism, the elastic member is shaped by bending a plate spring to form the convex section.

Preferably, in the belt tension adjustment mechanism, the elastic member is a spring which has the convex section in a spherical shape.

Preferably, the belt tension adjustment mechanism further includes a slide member which is provided between the elastic member and the intermediate transfer belt so as to be slidable on the intermediate transfer belt and not to be rotatable.

Preferably, in the belt tension adjustment mechanism, the elastic member is in direct contact with the intermediate transfer belt.

Preferably, in the belt tension adjustment mechanism, the elastic member is formed to be a long plate and contained to be fixed in a holder while being compressed in a running direction of the intermediate transfer belt, the holder having an opening section at one surface thereof, and the convex section protruding from the opening section is indirect contact with the intermediate transfer belt.

According to another aspect of the present invention, there is provided an image forming apparatus, including: an endless intermediate transfer belt which is rotated when a toner image is transferred; an image forming unit which forms the toner image on a photoreceptor drum, the toner image being transferred onto a sheet by using the intermediate transfer belt; and the belt tension adjustment mechanism according to claim 1.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DETAILED DESCRIPTION OF THE PREFERRED EMBODIMENT

Hereinafter, an embodiment of the present invention will be described in detail with reference to the drawings.

First, the configuration of the embodiment will be described.

Figure 1:
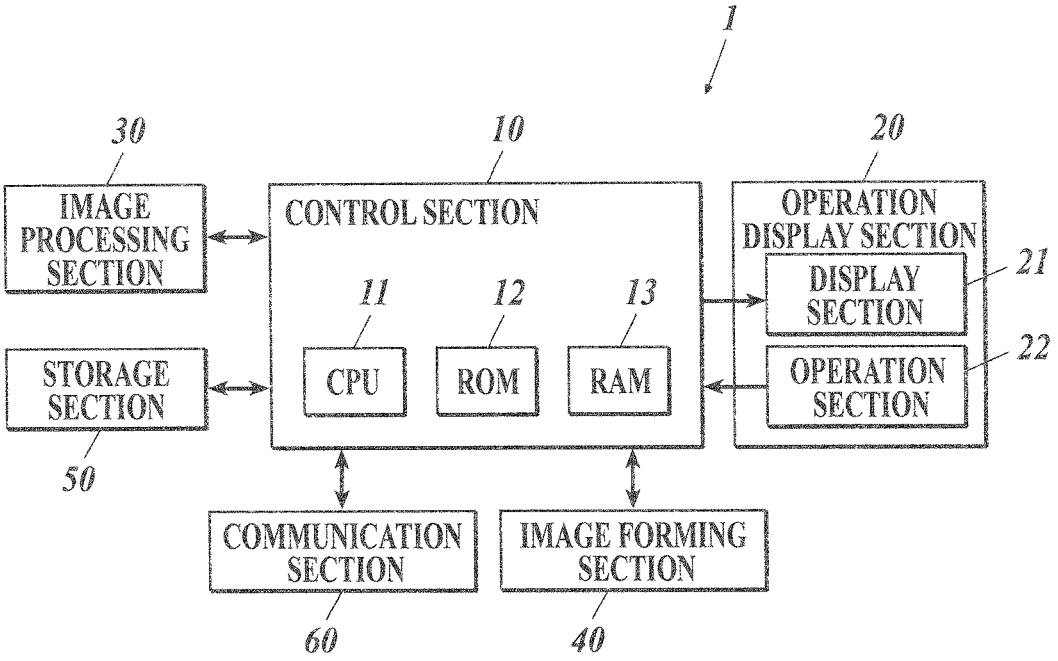
FIG. 1 is a block diagram showing a functional configuration of an image forming apparatus according to an embodiment.

An image forming apparatus 1 according to the embodiment is a color image forming apparatus which utilizes an electrophotographic process technique. As shown in FIG. 1, the image forming apparatus 1 includes a control section 10, an operation display section 20, an image processing section 30, an image forming section 40, a storage section 50 and a communication section 60, and the sections are connected to each other via a bus not shown in the drawings.

The control section 10 is configured by including a CPU 11, a ROM 12, a RAM 13 and such like. The CPU 11 of the control section 10 reads out a system program or a various type of processing program stored in the ROM 12, loads the program to the RAM 13 and integrally controls the operations of the sections in the image forming apparatus 1 in accordance with the loaded program.

The operation display section 20 includes a display section 21 and an operation section 22.

The display section 21 is configured by including an LCD (Liquid Crystal Display) and such like, and displays the status of various types of operation buttons and the apparatus and the operation state of each function on a display screen in accordance with the instruction of a display signal input from the control section 10.

The operation section 22, which includes various types of keys such as numeric keys and a start key, receives a key operation by a user and outputs the operation signal to the control section 10. The operation section 22 also has a pressure sensitive touch panel (resistive film pressure touch panel) in which transparent electrodes are arranged in a grid-like manner so as to cover the upper surface of the LCD of the display section 21. The operation section 22 detects, in a voltage value, the X-Y coordinate of a force point pressed by a finger, a touch pen or the like, and outputs the detected position signal as an operation signal to the control section 10. The touch panel is not limited to the pressure sensitive type and may be a static type, an optical type and others.

The image processing section 30 performs shading correction, color conversion, tone correction, tone reproduction processing (screen processing or error diffusion processing) and such like to the input image data (density gradation data) which was input via the communication section 60 or the like, and outputs the data to the image forming section 40.

The image forming section 40 performs image formation on a sheet by an electrophotographic system on the basis of input image data which was input from the image processing section 30. In the embodiment, the image forming section 40 performs color image formation by using colored toners of four colors that are yellow, magenta, cyan and black.

Figure 2:
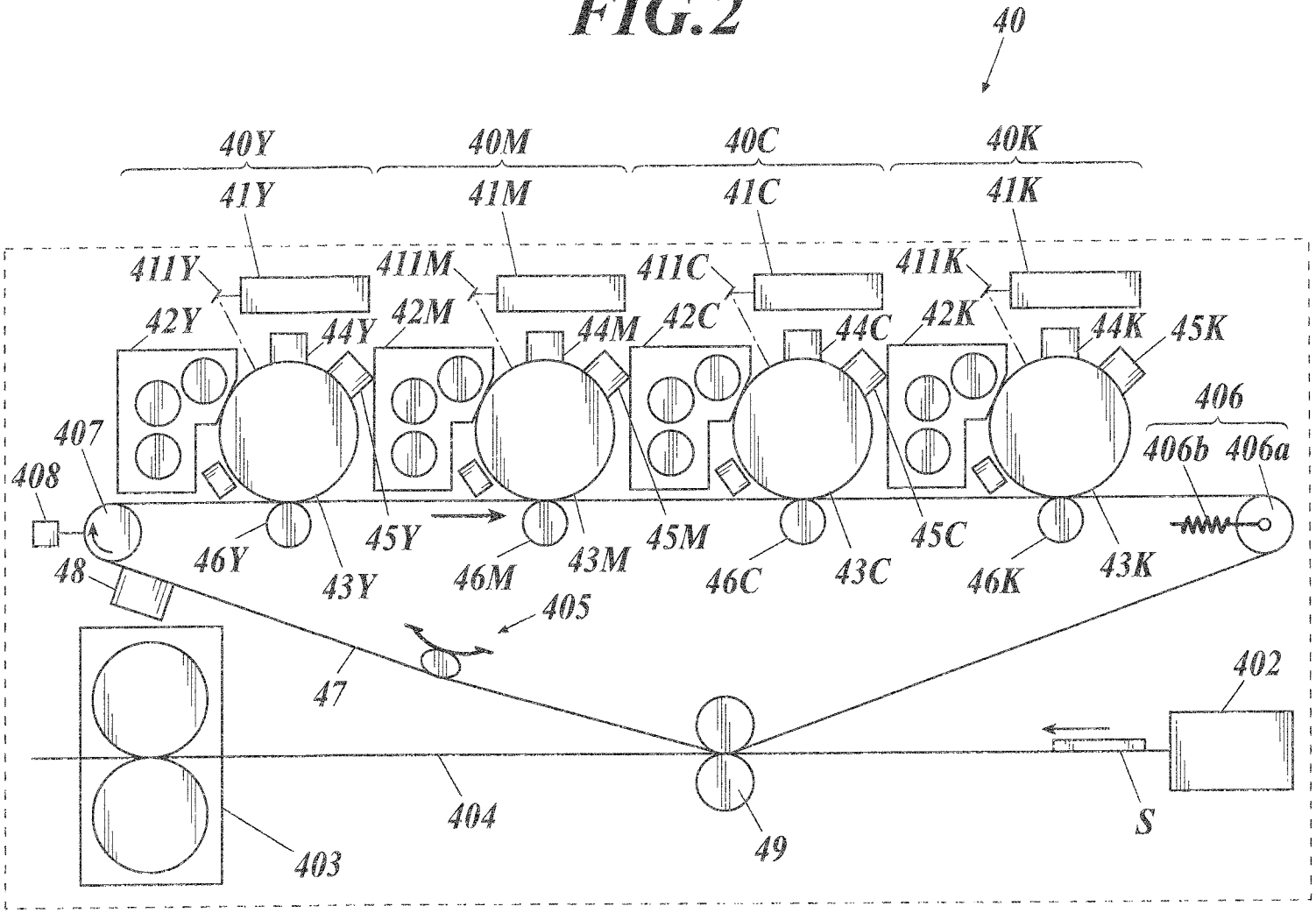
FIG. 2 is a view showing a schematic configuration of an image forming section.

As shown in FIG. 2, the image forming section 40 includes image forming units 40Y, 40M, 40C and 40K, an intermediate transfer belt 47, a cleaning section 48, a secondary transfer roller 49, a paper feeding section 402, a fixing unit 403, a conveyance section 404, a first belt tension adjustment mechanism 405, a second belt tension adjustment mechanism 406, a belt drive roller 407 and a belt drive motor 408. The Y, M, C and K of the respective units represent the toner colors treated by the respective units and represent the toner colors of yellow, magenta, cyan and black, respectively.

The image forming units 40Y, 40M, 40C and 40K are respectively configured by including exposure units 41Y, 41M, 41C and 41K, developing units 42Y, 42M, 42C and 42K, photoreceptor drums 43Y, 43M, 43C and 43K, charging sections 44Y, 44M, 44C and 44K, cleaning sections 45Y, 45M, 45C and 45K and primary transfer rollers 46Y, 46M, 46C and 46K. As shown in FIG. 2, the image forming units 40Y, 40M, 40C and 40K are disposed in parallel with each other at predetermined intervals along the running direction of the intermediate transfer belt 47. The image forming units 40Y, 40M, 40C and 40K respectively form toner images on the photoreceptor drums 43Y, 43M, 43C and 43K, the toner images being transferred onto the sheet by using the intermediate transfer belt 47.

Each of the exposure units 41Y, 41M, 41C and 41K is configured by including a laser source such as an LD (Laser Diode), a polygon mirror (polygon mirror 411Y, 411M, 411C and 411K), a plurality of lenses and such like. The exposure units 41Y, 41M, 41C and 41K respectively scan and expose the surfaces of photoreceptor drums 43Y, 43M, 43C and 43K with laser beams on the basis of image data transmitted from the image processing section 30. By the scanning and exposure with the laser beams, latent images are formed on the photoreceptor drums 43Y, 43M, 43C and 43K which are charged by the charging sections 44Y, 44M, 44C and 44K, respectively.

The corresponding developing units 42Y, 42M, 42C and 42K respectively attach the toners of respective color components to the latent images formed on the photoreceptor drums 43Y, 43M, 43C and 43K to visualize the latent images, and form toner images of the respective color components on the photoreceptor drums 43Y, 43M, 43C and 43K.

The toner images formed and carried on the photoreceptor drums 43Y, 43M, 43C and 43K are sequentially transferred to predetermined positions on the intermediate transfer belt 47 to be primary transferred by the primary transfer rollers 46Y, 46M, 46C and 46K to which a predetermined voltage is applied by a power source not shown in the drawings. The cleaning sections 45Y, 45M, 45C and 45K respectively remove toners remaining on the surfaces of photoreceptor drums 43Y, 43M, 43C and 43K for which the transferring of toner images has been finished.

The intermediate transfer belt 47 is a semi-conductive endless belt which is suspended on a plurality of rollers and supported to be rotatable. The intermediate transfer belt 47 is rotated in accordance with the rotation of rollers. The intermediate transfer belt 47 is rotated when the toner images are transferred.

The intermediate transfer belt 47 is in contact with the facing photoreceptor drums 43Y, 43M, 43C and 43K with pressure by the primary transfer rollers 46Y, 46M, 46C and 46K, respectively. A transfer current corresponding to the applied voltage flows through each of the primary transfer rollers 46Y, 46M, 46C and 46K. Thus, the toner images developed on the surfaces of photoreceptor drums 43Y, 43M, 43C and 43K are sequentially transferred (primary transferred) onto the intermediate transfer belt 47 by the primary transfer rollers 46Y, 46M, 46C and 46K, respectively.

The paper feeding section 402 feeds a sheet of paper (shown by S in FIG. 2) of a type instructed by the control section 10, and the conveyance section 404 conveys the sheet to the transferring position by the secondary transfer roller 49. The color toner images are transferred (secondary transfer) onto the conveyed sheet by the secondary transfer roller 49. After the transferring, the sheet is conveyed to the fixing unit 403 and the toner images transferred onto the sheet are fixed by heat. The remaining toners on the intermediate transfer belt 47 are removed by the belt cleaning section 48.

Figure 3:
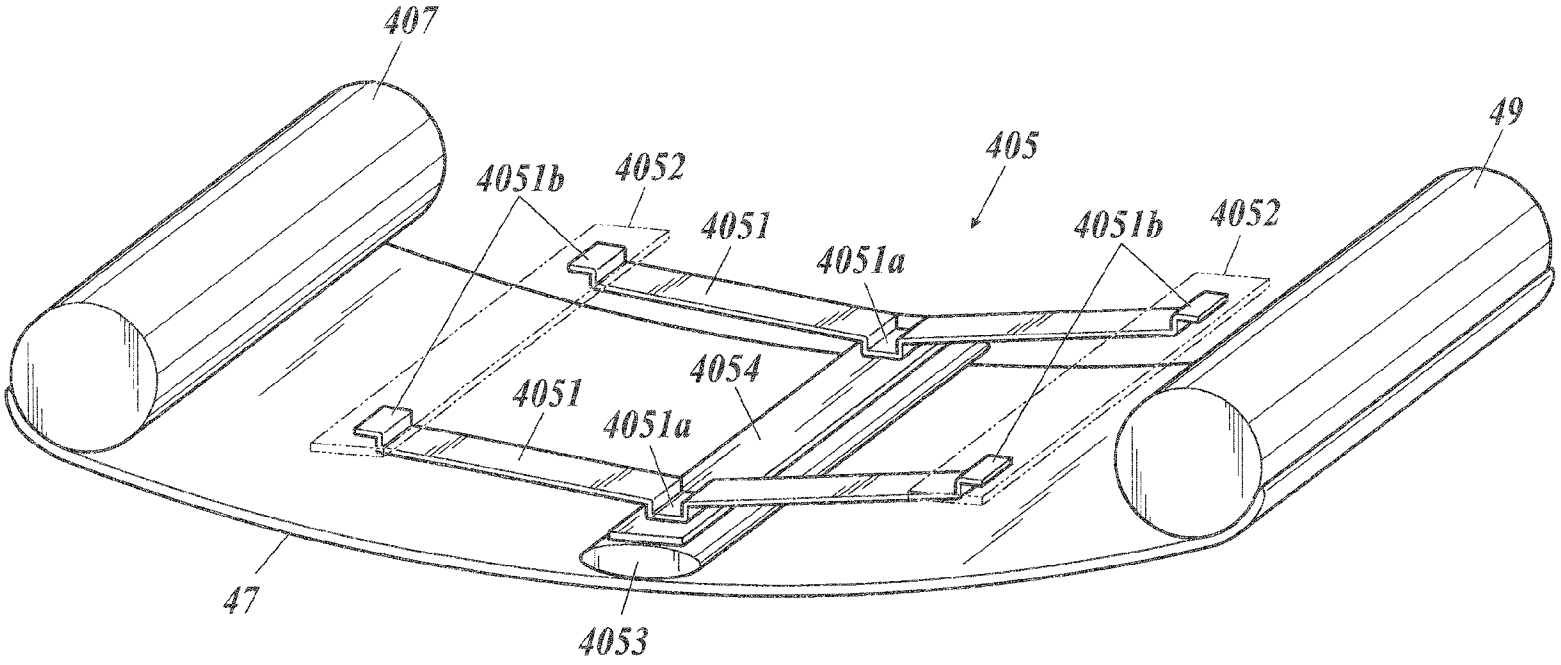
FIG. 3 is a perspective view showing a schematic configuration of a first belt tension adjustment mechanism.

As shown in FIG. 3, the first belt tension adjustment mechanism 405 includes: two elastic members 4051 which have protruding convex shapes and are disposed so that respective convex sections 4051*a* protrude in the orthogonal direction of the image transfer surface of the intermediate transfer belt 47 and face toward the intermediate transfer belt 47; two stays 4052 which fix respective end sections 4051*b* of the elastic members 4051 to an attachment section (not shown in the drawings) of the main body of the image forming apparatus 1; a pad member 4053 which is placed on the intermediate transfer belt 47 so as to be slidable; and a plate-like member 4054 which is placed on the pad member 4053 and connects the convex sections 4051*a* of the elastic members 4051 to the pad member 4053.

The elastic members 4051 are shaped by bending plate-like springs made of metal, resin, rubber and such like so as to form the convex sections 4051*a* so that the load applied to the intermediate transfer belt 47 is reduced as the intermediate transfer belt 47 is displaced inward and the convex sections 4051*a* are pressed inward via the pad member 4053 and the plate-like member 4054. The elastic members 4051 are fixed onto the plate-like member 4054 so that the longitudinal direction of the elastic members 4051 corresponds to the running direction of the intermediate transfer belt 47. The convex sections 4051*a* of the two elastic members 4051 are respectively fixed to the both end sections in the longitudinal direction of the plate-like member 4054.

The pad member (slide member) 4053, which is formed of a foamed polymeric material and such like, has a highly-slidable material attached to the contact surface (slide surface) thereof contacting the intermediate transfer belt 47, and the pad member 4053 is configured to slide on the intermediate transfer belt 47 without rotating. The pad member 4053 is placed on the intermediate transfer belt 47 so that the longitudinal direction thereof corresponds to the width direction of the intermediate transfer belt 47.

The plate-like member 4054 is fixed on the pad member 4053 so that the longitudinal direction thereof corresponds to the width direction of the intermediate transfer belt 47 similarly to the pad member 4053. The two convex sections 4051*a* of the elastic members 4051 are respectively fixed at the both end sections in the longitudinal direction of the upper surface of the plate-like member 4054. Thus, the load on the convex sections 4051*a* of elastic members 4051 are put on the entire surface of the pad member 4053 via the plate-like member 4054.

The second belt tension adjustment mechanism 406 is configured by including a tension roller 406*a* which applies a tension to the intermediate transfer belt 47 and a spring member 406*b* which forces the tension roller 406*a* toward the intermediate transfer belt 47. The second belt tension adjustment mechanism 406 is disposed downstream in the running direction of the image forming units 40Y, 40M, 40C and 40K. The second belt tension adjustment mechanism 406 applies a tension to the intermediate transfer belt 47 by forcing the tension roller 406*a* toward the intermediate transfer belt 47 with the spring member 406*b* and adding a load to the intermediate transfer belt 47.

Since the first belt tension adjustment mechanism. 405 and the second belt tension adjustment mechanism 406 are respectively provided before and after the secondary transfer roller 49, it is possible to suppress the transmission, to image generation sections such as photoreceptor drums 43Y, 43M, 43C and 43K, of the tension change of intermediate transfer belt 47 generated when the sheet comes to and from the secondary roller 49.

The storage section 50 is configured by including a non-volatile semiconductor memory, an HDD (Hard Disc Drive) or the like, and stores a system program executable by the image forming apparatus 1, various types of processing programs executable by the system program, data to be used when the various processing programs are executed, data of processing results obtained by the control section 10 performing arithmetic processing of data, and such like.

The communication section 60 including a modem, a LAN adapter and a router performs communication control between an external device and a PC (Personal Computer) connected to a communication network such as a LAN (Local Area Network) and a WAN (Wide Area Network), and receives image data, for example.

As described above, the first belt tension adjustment mechanism 405 of the image forming apparatus 1 according to the embodiment includes elastic members 4051 which reduce the load applied to the intermediate transfer belt 47 as the inward displacement amount of the intermediate transfer belt 47 increases.

Accordingly, the first belt tension adjustment mechanism 405 according to the embodiment can exclude a rotation supporting point and a direct guiding mechanism by making the elastic members 4051 bear both the function of constraining the motion to a prescribed position and the function of applying the load. Thus, it is possible to respond well to a rapid change of tension without being disturbed by the inertial force and the frictional force, and maintain the tension applied to the intermediate transfer belt 47 to be constant.

According to the first belt tension adjustment mechanism 405 in the embodiment, since the elastic members 4051 include the convex sections 4051*a* which are disposed so as to protrude in the direction orthogonal to the image transfer surface of the intermediate transfer belt 47, the shaping is relatively easy and it is possible to reduce the time and cost for the shaping work.

According to the first belt tension adjustment mechanism 405 in the embodiment, since the elastic members 4051 are shaped by bending plate-like springs to form the convex sections 4051*a*, the configuration can be simplified and it is possible to reduce work time and cost for placement, adjustment of elastic force and such like.

According to the first belt tension adjustment mechanism 405 in the embodiment, there is provided a slide member (pad member 4053) which is disposed between the elastic members 4051 and the intermediate transfer belt 47 so as to be slidable on the intermediate transfer belt 47 and not to be rotatable. Thus, by using the pad member 4053 which is light compared to the roller member, it is possible to reduce the weight of first belt tension adjustment mechanism 405 and make the first belt tension adjustment mechanism 405 respond to a more rapid change of tension.

As described above, though the embodiment according to the present invention has been specifically described, the present invention is not limited to the above embodiment and changes can be made within the scope of the invention.

MODIFICATION EXAMPLE 1

Figure 4:
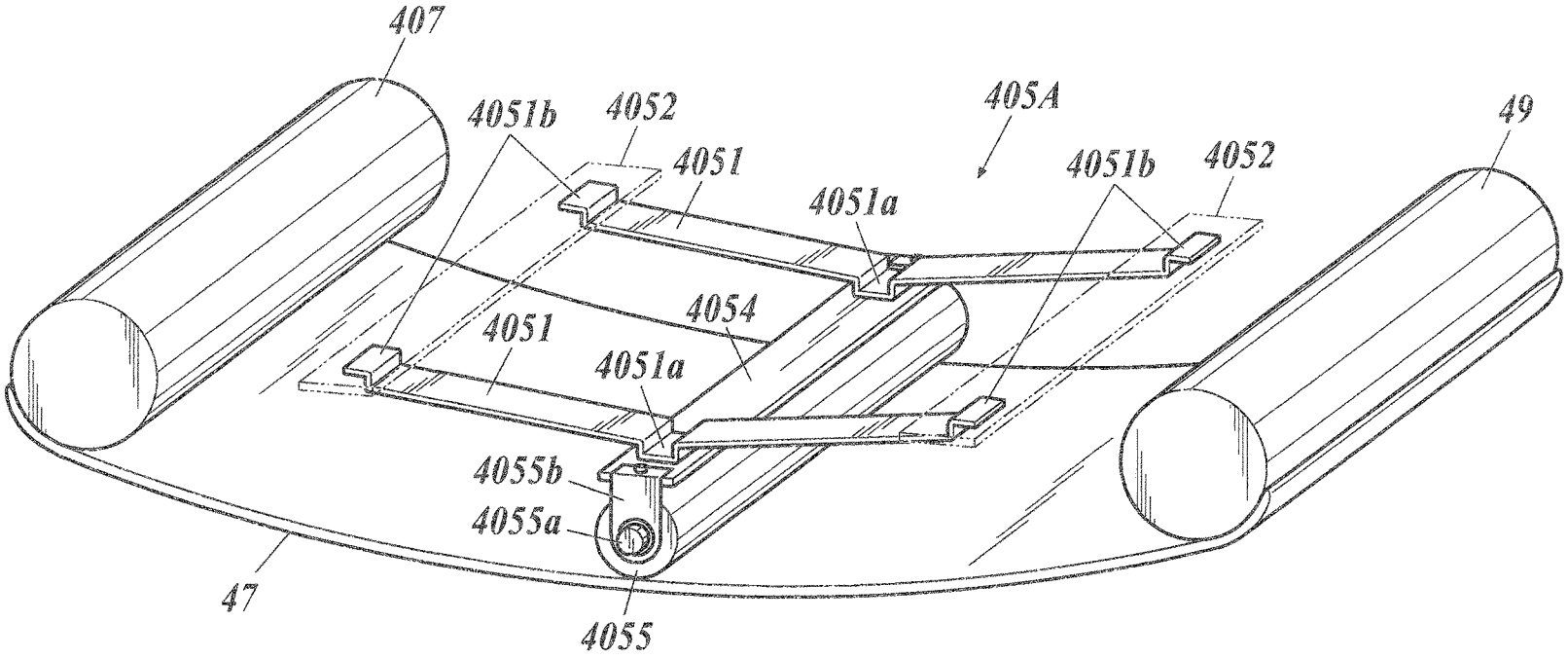
FIG. 4 is a perspective view showing a schematic configuration of a first belt tension adjustment mechanism according to a modification example 1.

For example, in the embodiment, the pad member 4053 is disposed between the elastic members 4051 and the intermediate transfer belt 47; however, the present invention is not limited to this. For example, as shown in FIG. 4, a rotatable roller member 4055 may be disposed instead of the pad member 4053 which is not rotatable. In order to simplify the explanation, same reference numerals are provided to the same configurations as those of the embodiment and detailed description is omitted.

Specifically, as shown in FIG. 4, a first belt tension adjustment mechanism 405A according to a modification example 1 is configured by including two elastic members 4051, two stays 4052, a roller member 4055 which is placed on the intermediate transfer belt 47 so as to be slidable, and a plate-like member 4054 which is connected to the roller member 4055 via supporting members 4055*b* and fixed to the convex sections 4051*a* of the elastic members 4051.

The roller member 4055 is placed on the intermediate transfer belt 47 so that the longitudinal direction thereof corresponds to the width direction of the intermediate transfer belt 47. A rotation shaft 4055*a* extending in the width direction of the intermediate transfer belt 47 is inserted through the roller member 4055 so that the roller member 4055 can rotate around the rotation shaft 4055*a* in conjunction with the running of the intermediate transfer belt 47. The roller member 4055 is connected to the plate-like member 4054 via supporting members 4055*b* supporting both ends of the rotation shaft 4055*a*.

The plate-like member 4054 is placed above the roller member 4055 so that the longitudinal direction thereof corresponds to the width direction of the intermediate transfer belt 47 similarly to the roller member 4055. The plate-like member 4054 is connected to the roller member 4055 via the supporting members 4055*b* at the respective end sections in the longitudinal direction. The two convex sections 4051*a* of the elastic members 4051 are fixed to the respective end sections in the longitudinal direction of the upper surface of the plate-like member 4054.

As described above, according to the first belt tension adjustment mechanism 405A in the modification example 1, in addition to the same effect as the embodiment, the slidability with respect to the intermediate transfer belt 47 can be more enhanced, and thus, it is possible to reduce the bad influence by the frictional force.

MODIFICATION EXAMPLE 2

Figure 5:
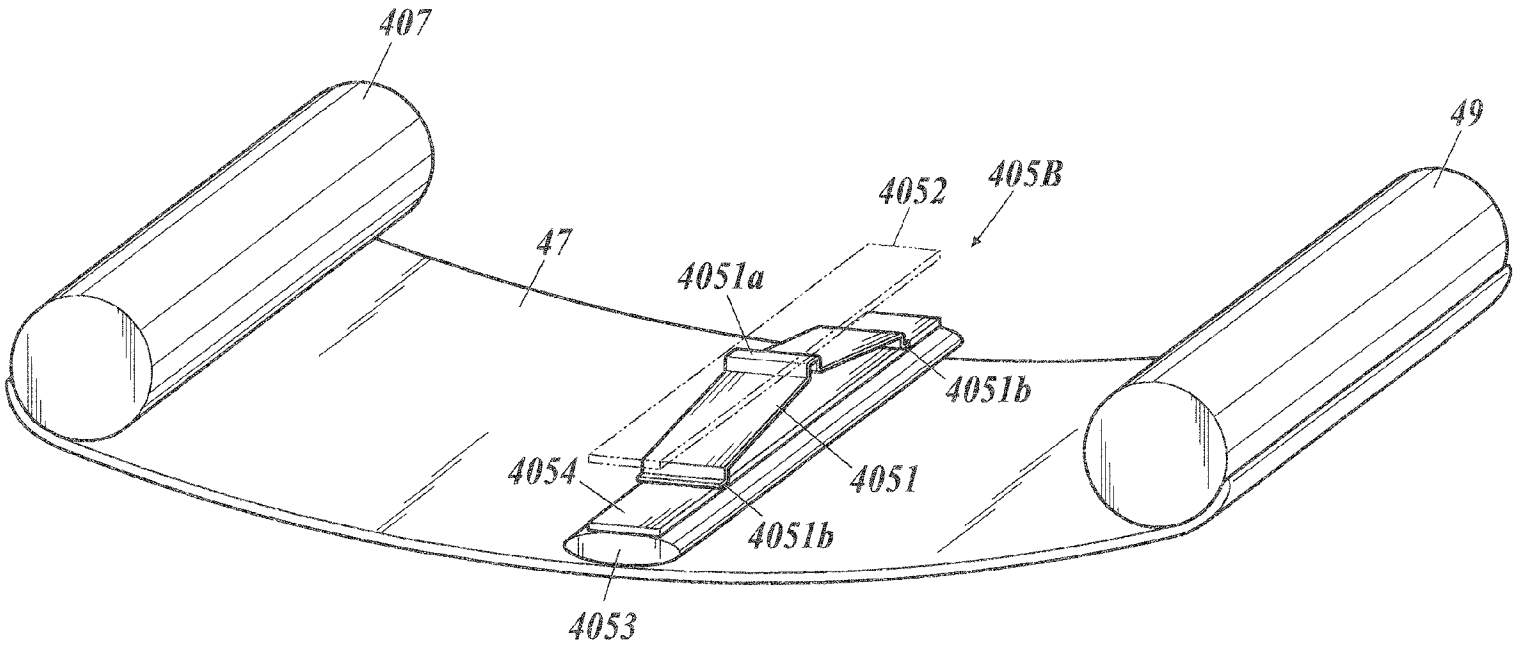
FIG. 5 is a perspective view showing a schematic configuration of a first belt tension adjustment mechanism according to a modification example 2.

In an example shown in FIG. 5, the number and location of the elastic member 4051 are different from those of the first belt tension adjustment mechanism 405 in the embodiment. In order to simplify the explanation, the detailed description is omitted by providing same reference numerals to the same configurations as those of the embodiment.

Specifically, as shown in FIG. 5, the first belt tension adjustment mechanism 405B according to the modification example 2 includes: an elastic member 4051 which is disposed so that the convex section 4051*a* protrudes toward the side opposite to the intermediate transfer belt 47 in the direction orthogonal to the image transfer surface of the intermediate transfer belt 47; a stay 4052 which fixes the convex section 4051*a* of the elastic member 4051 to the attachment section (not shown in the drawings) of the main body of the image forming apparatus 1; a pad member 4053 which is placed on the intermediate transfer belt 47 so as to be slidable; and a plate-like member 4054 which connects the end sections 4051*b* of the elastic member 4051 to the pad member 4053.

The elastic member 4051 is configured so that the load applied to the intermediate transfer belt 47 is reduced as the intermediate transfer belt 47 is displaced inward and the end sections 4051*b* are pressed inward via the pad member 4053 and the plate-like member 4054. The elastic member 4051 is fixed on the plate-like member 4054 so that the longitudinal direction thereof corresponds to the width direction of the intermediate transfer belt 47. The end sections 4051*b* of the elastic member 4051 are fixed to the end sections in the longitudinal direction of the plate-like member 4054.

The end sections 4051*b* of the elastic member 4051 are fixed to the respective end sections in the longitudinal direction of the upper surface of the plate-like member 4054. Thus, the load on the both end sections 4051*b* of the elastic member 4051 is put on the entire surface of the pad member 4053 via the plate-like member 4054.

As described above, according to the first belt tension adjustment mechanism 405B in the modification example 2, it is possible to dispose the first belt tension adjustment mechanism 405B even in a narrow space and thus reduce the entire size of the image forming apparatus 1 in addition to obtain the same effect as that of the embodiment.

MODIFICATION EXAMPLE 3

Figure 6:
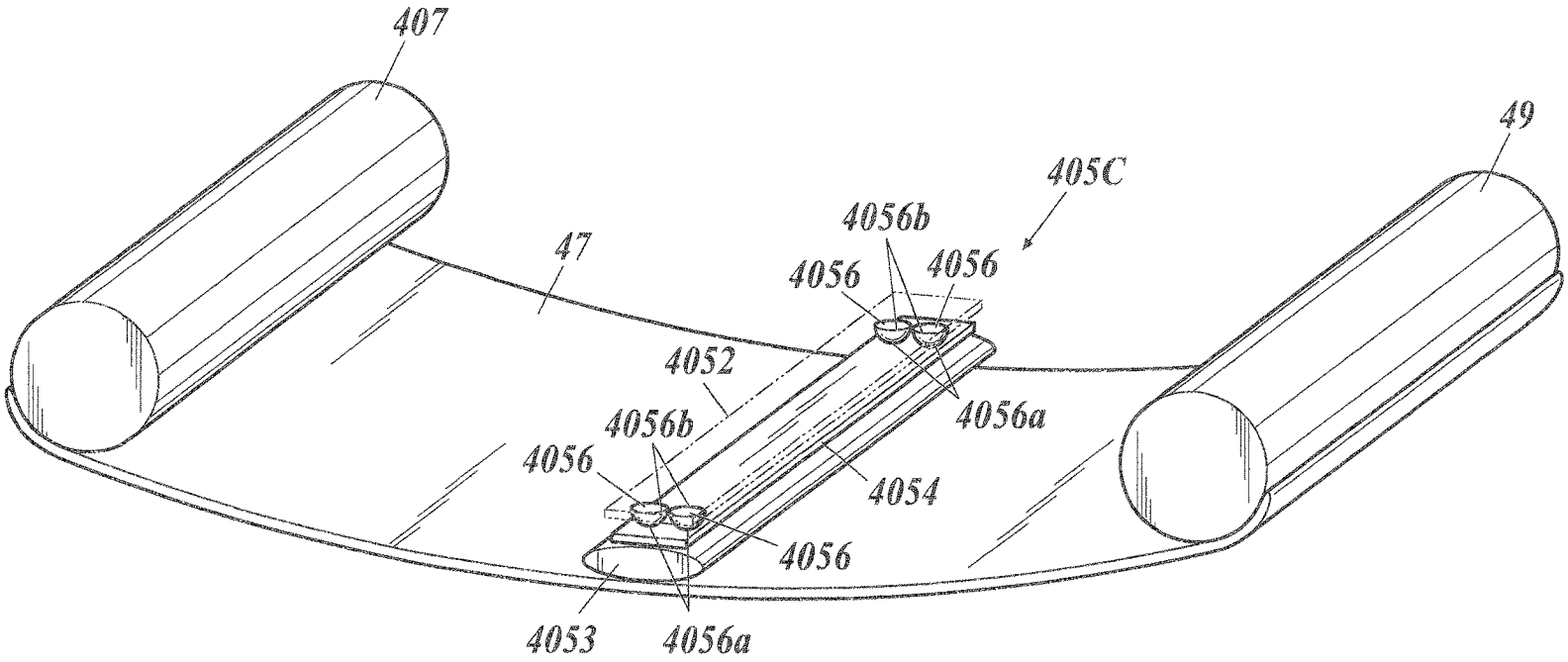
FIG. 6 is a perspective view showing a schematic configuration of a first belt tension adjustment mechanism according to a modification example 3.

In an example shown in FIG. 6, the shape and such like of elastic member 4056 are different from those of the first belt tension adjustment mechanism 405 in the embodiment. In order to simplify the explanation, the detailed description is omitted by providing same reference numerals to the same configurations as those of the embodiment.

Specifically, as shown in FIG. 6, a first belt tension adjustment mechanism 405C according to a modification example 3 includes: four elastic members 4056 which are disposed so that respective convex sections 4056*a* are spherical springs protruding toward the intermediate transfer belt 47 in the direction orthogonal to the image transfer surface of the intermediate transfer belt 47; a stay 4052 which fixes the end sections 4056*b* of the elastic members 4056 to the attachment section (not shown in the drawings) of the main body of the image forming apparatus 1; a pad member 4053 which is placed on the intermediate transfer belt 47 so as to be slidable; and a plate-like member 4054 which is placed on the pad member 4053 and connects the convex sections 4056*a* of the elastic members 4056 to the pad member 4053.

Each of the elastic members 4056 is formed of resin, rubber or such like to be semispherical, and the inside of the elastic member 4056 is hollow. The elastic members 4056 are configured so as to reduce the load applied to the intermediate transfer belt 47 as the intermediate transfer belt 47 is displaced inward and the convex sections 4056*a* are pressed inward via the pad member 4053 and the plate-like member 4054. Two elastic members 4056 are provided to each of the end sections in the longitudinal direction of the plate-like member 4054 so as to be disposed along the short direction of the plate-like member 4054.

In the modification example 3, the elastic members 4056 are formed to be semispherical; however, the present invention is not limited to this, and may use elastic members which are formed in a spherical shape larger or smaller than the semispherical shape.

In the modification example 3, two elastic members 4056 having spherical convex sections 4056*a* are provided to each of the end sections in the longitudinal direction of the plate-like member 4054 so as to be disposed along the short direction of the plate-like member 4054; however, the present invention is not limited to this. For example, a single elastic member 4056 may be provided to each of the end sections in the longitudinal direction of the plate-like member 4054, or three or more elastic members 4056 may be provide to each of the end sections. Alternatively, the elastic members 4056 may be disposed in a plurality of rows along the longitudinal direction, not only at the end sections in the longitudinal direction of the plate-like member 4054.

In the modification example 3, the elastic members 4056 have spherical convex sections 4056*a*; however, the same effect can also be obtained by using elastic members which have the convex sections 4056*a* formed in a dish shape, that is, plane instead of the elastic members 4056 having the spherical convex sections 4056*a*.

As described above, according to the first belt tension adjustment mechanism 405C in the modification example 3, the elastic members 4056 are springs having spherical convex sections 4056*a*. Thus, in addition to obtain the same effect as that of the embodiment, it is possible to shape the elastic members in a simplified configuration more easily than the elastic members 4051 in the embodiment which have the plate springs shaped to be convex, and it is possible to further reduce the work time and cost for the shaping work, placement, adjustment of elastic force and such like.

MODIFICATION EXAMPLE 4

Figure 7:
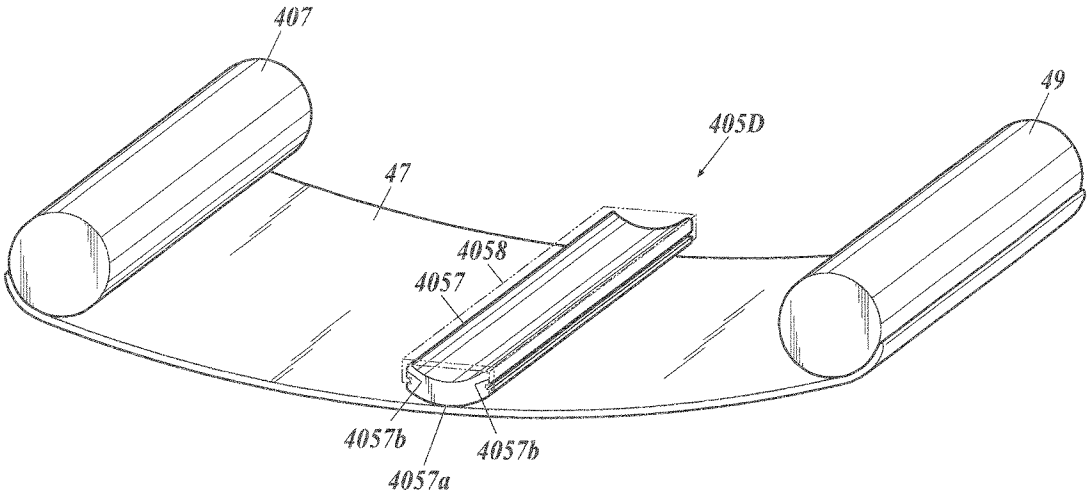
FIG. 7 is a perspective view showing a schematic configuration of a first belt tension adjustment mechanism according to a modification example 4.

The example shown in FIG. 7 is different from the first belt tension adjustment mechanism 405 according to the embodiment in that the elastic member 4057 has a different shape and the pad member 4053 is not provided in the example. In order to simplify the explanation, same reference numerals are provided to the same configurations as those of the embodiment and the detailed description thereof is omitted.

Specifically, as shown in FIG. 7, a first belt tension adjustment mechanism 405D according to a modification example 4 includes: an elastic member 4057 which is disposed so that the convex section 4057*a* protrudes toward the intermediate transfer belt 47 in the direction orthogonal to the image transfer surface of the intermediate transfer belt 47; and a holder 4058 which supports the both end sections 4057*b* of the elastic member 4057 to be fixed to the attachment section (not shown in the drawings) of the main body of the image forming apparatus 1.

The elastic member 4057 is formed of a foamed polymeric material or such like to be a long plate, compressed in the running direction of the intermediate transfer belt 47 and contained in the holder 4058, which has an opening section at one surface thereof, so as to fix the positions of the end sections 4057*b*. The elastic member 4057 is compressed in the running direction of the intermediate transfer belt 47, the convex section 4057*a* protruding from the opening section is in direct contact with the intermediate transfer belt 47 and slides on the intermediate transfer belt 47 without rotation.

As described above, according to the first belt tension adjustment mechanism 405D in the modification example 4, the elastic member 4057 is formed to be a long plate and contained to be fixed in the holder 4058 while being compressed in the running direction of the intermediate transfer belt 47, the holder 4058 having the opening section at one surface thereof, and the convex section 4057*a* protruding from the opening section directly contacts the intermediate transfer belt 47. Thus, it is possible to change the load applied to the intermediate transfer belt 47 not only by the elasticity of the elastic member 4057 but also by changing the shape of the elastic member 4057, and suppress the change in tension applied to the intermediate transfer belt 47 more flexibly.

OTHER MODIFICATION EXAMPLE

In the modification example 3, the pad member 4053 (and the plate-like member 4054) are provided between the elastic members 4056 and the intermediate transfer belt 47; however, the present invention is not limited to this. That is, the elastic members 4056 may directly contact the intermediate transfer belt 47 without providing the pad member 4053 and the plate-like member 4054 by forming the elastic members 4056 with a material having a high slidability and providing the elastic members 4056 in a plurality of rows not only in the short direction of the plate-like member 4054 but also in the longitudinal direction.

Thus, since the number of parts can be reduced, it is possible to further reduce the weight of the first belt tension adjustment mechanism 405.

As for the other detailed configurations and detailed operations of units forming the belt tension adjustment mechanism and the image forming apparatus, changes can be appropriately made within the scope of the present invention.

According to one aspect of a preferred embodiment of the present invention, there is provided a belt tension adjustment mechanism which is provided on an inner side of an endless intermediate transfer belt and applies a tension to the intermediate transfer belt, the intermediate transfer belt being rotated when a toner image is transferred, and the belt tension adjustment mechanism including an elastic member which reduces a load applied to the intermediate transfer belt along with an increase in an inward displacement amount of the intermediate transfer belt.

In the belt tension adjustment mechanism, the tension applied to the intermediate transfer belt can be maintained constant.

The entire disclosure of Japanese Patent Application No. 2014-253697 filed on Dec. 16, 2014 including description, claims, drawings, and abstract are incorporated herein by reference in its entirety.

What is claimed is:

1. A belt tension adjustment mechanism that is provided on an inner side of an endless intermediate transfer belt and that applies a tension to the intermediate transfer belt which is rotated when a toner image is transferred onto the intermediate transfer belt, said belt tension adjustment mechanism comprising:

a holder having an opening section at one surface thereof; and an elastic member which is contained to be fixed in the holder while being compressed in a running direction of the intermediate transfer belt, thereby forming a convex section of the elastic member which protrudes from the opening section of the holder toward a direction orthogonal to an image transfer surface of the intermediate transfer belt, the convex section being in direct contact with the intermediate transfer belt.

2. The belt tension adjustment mechanism according to claim 1, wherein the elastic member comprises a long plate and is fixed in the holder while being compressed in the running direction of the intermediate transfer belt, thereby forming the convex section of the elastic member which protrudes from the opening section of the holder toward the direction orthogonal to the image transfer surface of the intermediate transfer belt, the convex section of the elastic member being in direct contact with the intermediate transfer belt and sliding on the intermediate belt without rotation.

3. The belt tension adjustment mechanism according to claim 1, wherein the elastic member reduces a load applied to the intermediate transfer belt along with an increase in an inward displacement amount of the intermediate transfer belt.

4. The belt tension adjustment mechanism according to claim 1, wherein the elastic member is formed of a foamed polymeric material.

5. An image forming apparatus comprising:

an image forming unit which forms a toner image on a photoreceptor;

an endless intermediate transfer belt which is rotated when the toner image formed on the photoreceptor is transferred onto the intermediate transfer belt, the toner image transferred onto the intermediate transfer belt being transferred onto a sheet in contact with the intermediate transfer belt; and a belt tension adjustment mechanism that is provided on an inner side of the intermediate transfer belt and that applies a tension to the rotated intermediate transfer belt, the belt tension adjustment mechanism comprising:

a holder having an opening section at one surface thereof; and an elastic member which is contained to be fixed in the holder while being compressed in a running direction of the intermediate transfer belt, thereby forming a convex section of the elastic member which protrudes from the opening section of the holder toward a direction orthogonal to an image transfer surface of the intermediate transfer belt, the convex section being in direct contact with the intermediate transfer belt.

6. The image forming apparatus according to claim 5, wherein the elastic member of the belt tension adjustment mechanism reduces a load applied to the intermediate transfer belt along with an increase in an inward displacement amount of the intermediate transfer belt.

7. The image forming apparatus according to claim 5, wherein the elastic member of the belt tension adjustment mechanism comprises a long plate and is fixed in the holder while being compressed in the running direction of the intermediate transfer belt, thereby forming the convex section of the elastic member which protrudes from the opening section of the holder toward the direction orthogonal to the image transfer surface of the intermediate transfer belt, the convex section of the elastic member being in direct contact with the intermediate transfer belt and sliding on the intermediate belt without rotation.

8. The image forming apparatus according to claim 5, wherein the elastic member of the belt tension adjustment mechanism is formed of a foamed polymeric material.

9. The image forming apparatus according to claim 5, further comprising a second belt tension adjustment mechanism including a tension roller and a spring member, wherein the tension roller applies a tension to the rotated intermediate transfer belt and the spring member forces the tension roller toward the rotated intermediate transfer belt.

10. An image forming apparatus comprising:

an image forming unit which forms a toner image on a photoreceptor;

an endless intermediate transfer belt which is rotated when the toner image formed on the photoreceptor is transferred onto the intermediate transfer belt, the toner image transferred onto the intermediate transfer belt being transferred onto a sheet in contact with the intermediate transfer belt; and a belt tension adjustment mechanism provided on an inner side of the endless intermediate transfer belt for applying a tension to the rotated intermediate transfer belt and comprising an elastic member, wherein the elastic member includes a convex section protruding toward a direction orthogonal to an image transfer surface of the intermediate transfer belt, and the elastic member reduces a load applied to the intermediate transfer belt as an inward displacement amount of the intermediate transfer belt increases, wherein the belt tension adjustment mechanism further comprises a holder having an opening section at one surface thereof, and wherein the elastic member is contained to be fixed in the holder while being compressed in a running direction of the intermediate transfer belt, thereby forming the convex section of the elastic member which protrudes from the opening section of the holder toward the direction orthogonal to the image transfer surface of the intermediate transfer belt, the convex section being in direct contact with the intermediate transfer belt.

11. The image forming apparatus according to claim 10, wherein the elastic member of the belt tension adjustment mechanism comprises a long plate and is fixed in the holder while being compressed in the running direction of the intermediate transfer belt, thereby forming the convex section of the elastic member which protrudes from the opening section of the holder toward the direction orthogonal to the image transfer surface of the intermediate transfer belt, the convex section of the elastic member being in direct contact with the intermediate transfer belt and sliding on the intermediate belt without rotation.

12. The image forming apparatus according to claim 10, wherein the elastic member of the belt tension adjustment mechanism is formed of a foamed polymeric material.

13. The image forming apparatus according to claim 10, further comprising a second belt tension adjustment mechanism including a tension roller and a spring member, wherein the tension roller applies a tension to the rotated intermediate transfer belt and the spring member forces the tension roller toward the intermediate transfer belt.

* * * * *